United States Patent [19]

Klaeger

[11] Patent Number: 5,031,402

[45] Date of Patent: Jul. 16, 1991

[54] PNEUMATIC PUMP ACTUATOR FOR OIL WELLS

[76] Inventor: Joseph H. Klaeger, P.O. Drawer 445, Hondo, Tex. 78861

[21] Appl. No.: 561,954

[22] Filed: Aug. 2, 1990

[51] Int. Cl.[5] ..... F16D 31/02

[52] U.S. Cl. ..... 60/369; 60/370; 60/371; 91/303; 91/321; 91/330; 92/110; 417/401

[58] Field of Search ..... 60/369, 370, 371, 372, 60/407, 412; 91/303, 304, 321, 330; 92/110, 150, 151; 417/403, 404, 401

[56] References Cited

U.S. PATENT DOCUMENTS

| | | | |
|---|---|---|---|
| 1,892,852 | 1/1933 | Rawles et al. | 92/151 |
| 2,049,872 | 8/1936 | Sera | 92/110 |
| 3,643,432 | 2/1972 | Klaeger | 60/412 |
| 3,782,247 | 1/1974 | Klaeger | 91/306 |
| 3,880,051 | 4/1975 | Eppler | 92/151 X |
| 3,932,990 | 1/1976 | Klaeger | 60/369 |
| 3,971,213 | 7/1976 | Kelley | 60/407 |
| 3,986,355 | 10/1976 | Klaeger | 91/303 |
| 4,501,119 | 2/1985 | Stanton | 60/370 |
| 4,707,993 | 11/1987 | Kime | 60/372 |
| 4,919,597 | 4/1990 | Kistner | 417/403 |

FOREIGN PATENT DOCUMENTS

| | | | |
|---|---|---|---|
| 2091816 | 8/1982 | United Kingdom | 92/151 |

*Primary Examiner*—Edward K. Look
*Assistant Examiner*—Todd Mattingly
*Attorney, Agent, or Firm*—Vaden, Eickenroht, Thompson & Boulware

[57] ABSTRACT

A wellhead mounted pneumatic actuator for bottom hole oil pumps designed for operation by compressed air or gas. The preferred embodiment utilizes a single action cylinder with the downstroke actuated by the weight of the sucker rods and the fluid contained therein. Sufficient relatively high pressure air or gas from an external source is supplied under the piston of the cylinder to lift the piston at all times. A pressure or solenoid control floating piston bleeder valve selectively routes air or gas into the power cylinder on both sides of the piston to accomplish the downstroke. First and second contactors are mounted to cables suspended from a spreader reciprocating with the piston to contact respective first and second pivot arms to pivot the pivot arms into engagement with the respective first and second activator buttons of the bleeder valve to shift the bleeder valve from one position to the other to effectuate the selective routing of air or gas to the top of the piston as well as under the piston. The contactors are releasably mounted to the cables for securing at different locations therealong to adjust the length of the stroke of the piston. The actuator also includes an improved seal or packing gland.

15 Claims, 2 Drawing Sheets

2
38
40
108
114
64
70
106
58
86
84
124
42
82
10
88
104
122
60
56
49
46
48
90
V
51
44
P
M
54
50
12
2
16
14
26
32
30
18
36
34
28
24
20
22

3
38
116
114
108
64
110
70
86
58
84
82
60
122
88
56
90
54
50
12
3

PNEUMATIC PUMP ACTUATOR FOR OIL WELLS

BACKGROUND OF THE INVENTION

The present invention relates to an improved pneumatic actuator for oil well pumps which is operated by the pneumatic pressure of the wellhead gas or by an external air source. In more detail, the present invention relates to a pneumatic actuator that is secured to a wellhead for reciprocating either hollow or solid sucker rods and used in conjunction with a wide variety of reciprocating plunger-type oil well pumps.

The present invention is intended for use in the same application as the pneumatic pump actuator described in my U.S. Pat. No. 3,643,432 and is an improvement on that device. That device is used on wells having standard strings of rods and tubing or wells having a single tubing string, and its construction is shown in FIG. 1 of that patent. That device requires the securing of a mounting frame assembly (reference numeral 11 in the figures of that patent) including a bottom plate 14, side support structure 15 and cylinder base plate 16, and the vertical dimension of side support structure 15 must exceed the length of the stroke of the piston 19 in cylinder 17 to allow travel of hollow tubing 23 and polished rod 18 up and down to discharge fluid through outlet 51. Both mounting frame assembly 11 and cylinder 17 are installed on top of the well casing 12, making the entire unit very tall (the '432 patent describes an actuator built in accordance with that patent having a 36 inch stroke; when the height of mounting frame assembly 11 and the other parts of the device are added to that 36 inch stroke, total height may exceed 7 feet) and therefore, hard to work on.

The pump actuator described in that patent and also, for instance, in my U.S. Pat. Nos. 3,782,247 and 3,986,355, uses a solid polished rod 18 which extends upwardly through the mounting frame assembly 11 and on up to the piston 19 where it is secured to the piston 19 by a nut 21 on the end of the rod 18. That structure requires that piston rod 18 project through an aperture in the cylinder base plate 16 such that piston rod 18 must be sealed against air or gas leakage by a packing gland 22. Although such pump actuators having given years of satisfactory service, packing gland 22 has proven to be troublesome because it is hard to keep it from leaking. Further attempts to reduce leakage by replacing packing gland 22 on a regular basis are hampered by the difficulty, resulting from the structure of the device, of replacing the packing gland 22.

Further, although not necessarily described in the specification of that patent, the device described in the '432 patent was designed to be used on wells having a wide range of depths and pressures, and was, therefore, designed with high pressure applications in mind. Of course, if designed for that purpose, the device must include certain structure, e.g., for internal braking, reversing controls, and so on, all made with high pressure components. The result is a unit which is relatively expensive to build, install, and maintain. Such expense is a problem in the case of many wells which are marginal producers such as, for instance, the shallow stripper wells so common throughout the southern portion of the great state of Texas. Such wells, many of which produce less than, for instance, two barrels of oil per day, are such slow producers that the replacement cost of new rods, tubing and pumping units is prohibitive. Consequently, stripper wells in Texas, and throughout the world, are being plugged and abandoned when that equipment wears out in spite of the fact that they may be steady producers and may have relatively large reservoirs. There is, therefore, a need for a pump actuator which is inexpensive to build, install and maintain, and which will operate reliably and efficiently, and it is a primary purpose of the present invention to provide an improved pump actuator which meets those criteria.

Another object of the present invention is to provide a pump actuator which is adapted for use in connection with other production equipment designed with this same principal objective. For instance, production of oil through hollow sucker rods eliminates the need for at least one complete set of downhole tubing, thereby decreasing costs, and the present invention is intended for use with such rod strings. The present invention is also intended to take maximum advantage of the cooperation possible between pump and pump actuator in that the pump actuator is intended for use in connection with the hollow rod, downhole pump described in my co-pending application Ser. No. 07/518,166. For instance, that pump avoids sanding and gas lock problems by contacting the standing valve with the traveling valve during the downstroke as the plunger nears the maximum extent of downward travel in the barrel. For proper operation of such a pump, stroke length is important, and the present invention provides a pump actuator in which stroke length can be adjusted in seconds, even during production operations. As an example of how such combinations can make old stripper wells profitable, such a system can produce oil efficiently from depths of up to about 1500 feet with a 1½ inch bottom hole pump through 1 5/16 inch tubing using an eight inch I.D. power cylinder and 36 inch stroke length with air compressed to less than 50 psi. Many stripper wells are not much more than 300 feet apart, and such wells therefore lend themselves to being operated from a single source of compressed air using pump actuators constructed in accordance with the present invention which have an installed cost of about $300 each, a dramatic cost reduction compared to conventional equipment. These costs and operating efficiencies can make an entire once-marginal field profitable again.

Other advantages of the present invention will be apparent to those skilled in the art from the following detailed description of a presently preferred embodiment of a pneumatic pump actuator constructed in accordance therewith.

SUMMARY OF THE INVENTION

The advantages and objects of the present invention are achieved by providing a pneumatic pump actuator comprising a power cylinder having a sucker rod passing therethrough and a piston mounted to the sucker rod for reciprocation inside the cylinder, means for selectively routing air or gas into the power cylinder on a first or the first and a second side of the piston, and a floating piston bleeder valve shiftable from a first to a second position and back to the first position for supplying air or gas to the air routing means and on to the first or the first and second sides of the piston. First and second pivot arms are mounted near the ends of the bleeder valve for engaging respective first and second activator buttons on the ends of the bleeder valve for shifting the bleeder valve from the first to the second position and back to the first position. Also provided are first and second contactors and means reciprocating with the piston for mounting the first and second contactors in close proximity to the respective first and second pivot arms, the first contactor being mounted on said contactor mounting means at a position selected so as to cause the first contactor to contact the first pivot arm at a selected point on the upstroke of the piston to cause the first pivot arm to engage the first activator button to shift the bleeder valve from the first to the second position to reverse the direction of travel of the piston and the position of the second contactor being selected so as to contact the second pivot arm at a selected point on the downstroke of the piston to cause the second pivot arm to engage the second activator button to shift the bleeder valve from the second to the first position to again reverse the direction of travel of the piston. In a preferred embodiment, the contactor mounting means takes the form of a spreader mounted to the sucker rod and having first and second cables suspended from the respective first and second ends thereof to which the respective first and second contactors are mounted.

BRIEF DESCRIPTION OF THE PREFERRED EMBODIMENT

Figures 1, 2:
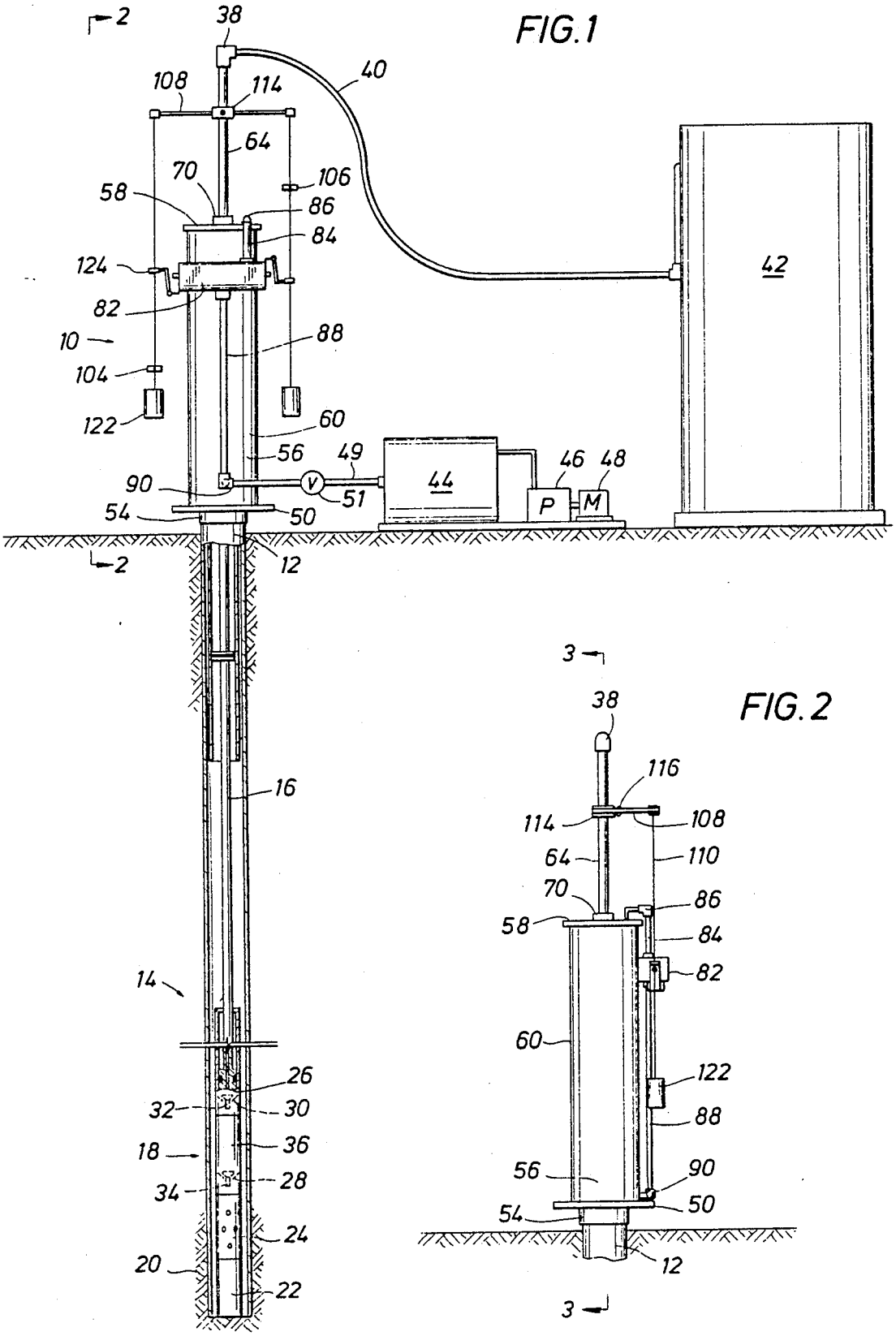
FIG. 1 is a partially cutaway front view of a pump actuator constructed in accordance with the present invention that has been installed on the wellhead of an oil well.
FIG. 2 is a side view of the pump actuator of FIG. 1.

Referring now to the figures, a preferred embodiment of a pump actuator constructed in accordance with the present invention is indicated generally at reference numeral 10. The pump actuator 10 is installed on the wellhead 12 of an oil well 14, being operatively connected by a string of sucker rods 16 to a bottom hole pump 18. Pump 18 is anchored in producing formation 20 by a lead bar 22 or other anchor as is known in the art, the oil being produced through the perforated barrel 24 therebetween upon reciprocation of the plunger 26 and the consequent opening and closing of standing 28 and traveling 30 valves.

As noted above, bottom hole pump is preferably constructed in accordance with the pump disclosed in my co-pending application Ser. No. 07/518,166, entitled ROD ACTUATED PUMP AND METHOD, filed on May 3, 1990, and the disclosure of that co-pending application is hereby incorporated into this specification in its entirety by this specific reference thereto. Briefly, the pump described in that application avoids the sanding and gas-locking problems of conventional bottom hole pumps by providing a bearing surface on the valve member 32 of traveling valve 30 which contacts a bearing surface on the valve member 34 of standing valve 28 as the plunger 26 nears the maximum extent of downward travel.

The contact between traveling and standing valve members 32 and 34, respectively, has at least two benefits. In the event the pump 18 is pumped off or gas locked, the contact between valve members opens traveling valve 30 to allow oil in the plunger 26 back through traveling valve to fill the chamber 36 between traveling valve 30 and standing valve 28 to increase the fluid pressure in chamber 36 to a point at which that fluid pressure will be greater than the fluid pressure in plunger 26 on the next downstroke of plunger 26 to force traveling valve 30 open during that downstroke, breaking the gas locked condition. In the event that sand, scale or other particulate matter lodges in standing valve 28, preventing that valve from closing, the contact between respective valve members converts the fluid pressure in plunger 26 into mechanical energy forcing standing valve 28 closed and dislodging the particulate matter. Also, during the downstroke of plunger 26, the fluid in chamber 36 is being forced out of the chamber 36 so that, when traveling valve 30 opens as a result of contact between respective valve members, a stream of relatively high pressure oil is directed down through traveling valve 30 onto standing valve 28, rinsing or washing the particulate matter lodged therein out of standing valve 28.

Oil pumped out of the producing formation 20 and into bottom hole pump 18 is lifted to the surface through a string 16 of hollow sucker rods which, in the preferred embodiment shown in the figures, extends through pump actuator 10 to a suitable coupling 38 for a flexible connector hose 40 and on into a suitable storage tank 42. As will be described, in that preferred embodiment pump actuator 10 is powered by an external source of relatively high pressure air such as may be stored in a tank 44 which is replenished by a compressor 46 powered by motor 48. A high pressure line 49, having a master shut-off valve 51 therein, connects air tank 44 with pump actuator 10 as will be explained. Although the structure for doing so is not shown, high pressure gas may also be taken from the well 14, or from another well, for powering pump actuator 10, and conventional filters, oiler(s), and pressure regulators(s) are provided for conditioning and controlling the high pressure air or gas.

Figure 3:
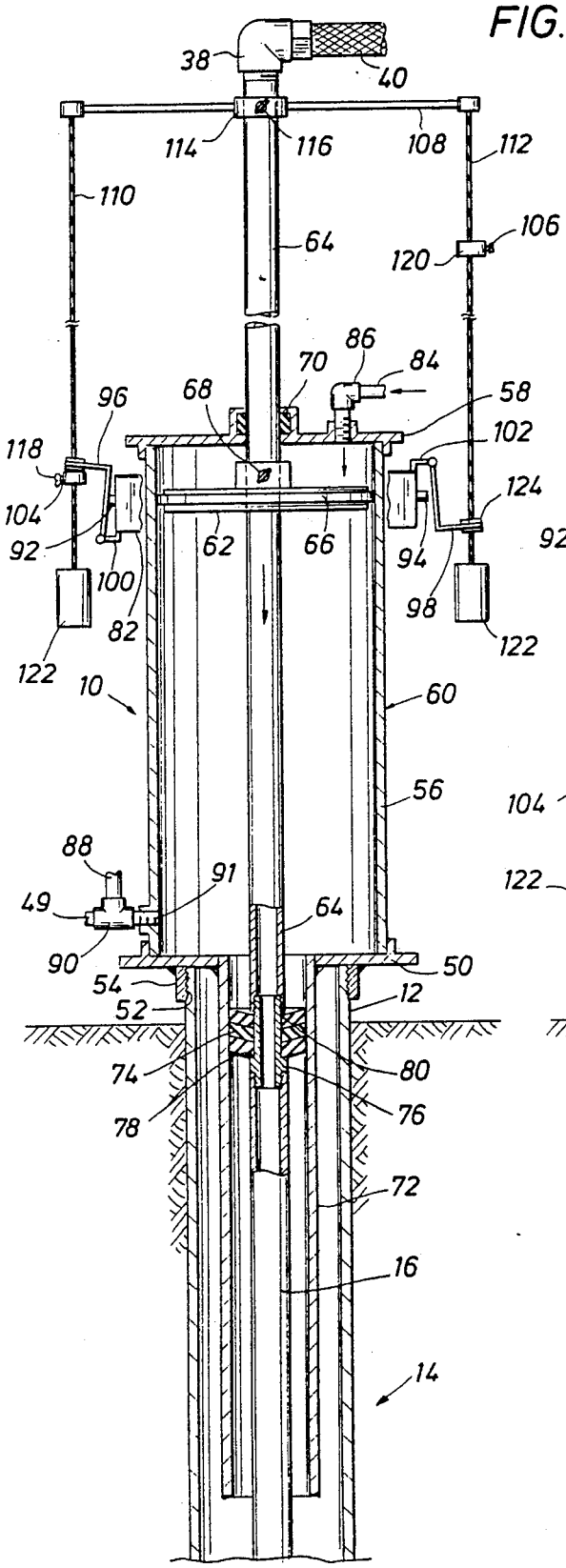
FIG. 3 is a longitudinal sectional view through the pump actuator of FIG. 1 taken along the lines 3—3 in FIG. 1 showing the piston of the pump at the beginning of a downstroke.
Figure 4:
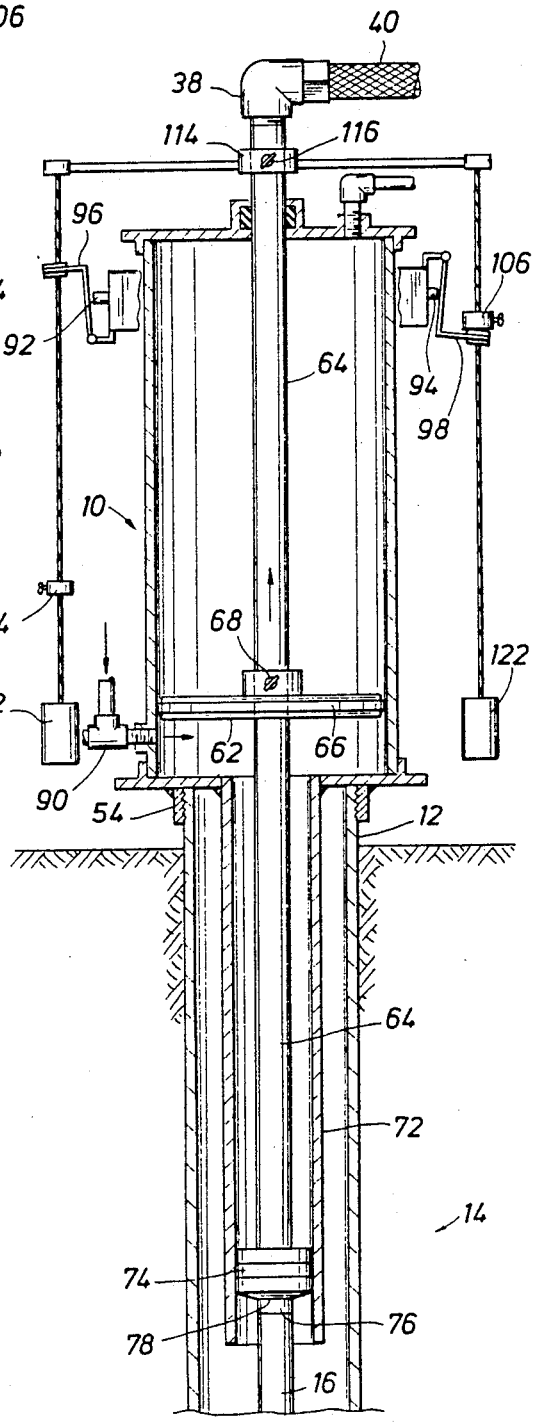
FIG. 4 is a longitudinal sectional view similar to the view shown in FIG. 3, but with the piston of the pump actuator at the start of the upstroke.

Referring now to FIGS. 2–4, the pump actuator 10 is shown in more detail. A base plate 50 is adapted to be secured to the wellhead 12 by the threads 52 formed in a downwardly extending collar 54 integral therewith for screwing onto the wellhead 12. Base plate 50 supports the side walls 56 extending upwardly therefrom and, together with the cover 58 of the top thereof, forms a power cylinder 60. A piston 62 is mounted to the uppermost sucker rod 64 of string 16 which extends longitudinally through power cylinder 60 for reciprocation in power cylinder 60. Piston rings or sealing glands 66 are utilized on the outer edge of piston 62 to produce a substantially airtight seal against the inside surface of the side wall 56 of power cylinder 60. Piston 62 is mounted to sucker rod 64 by a suitable piston rod securing means 68.

Uppermost sucker rod 64 projects through an opening in the cover 58 and is sealed against leakage of air or gas by means of a piston rod packing gland 70. Sucker rod 64 also passes through an opening in base plate 50 which is provided with a sleeve 72 extending downwardly into the wellhead 12 to which base plate 50 is mounted to a length longer than the length of the stroke of piston 62 in power cylinder 60 and is concentric with sucker rod 64. Sealing means, in the form of the resilient cups 74, are mounted to sucker rod 64 for reciprocation therewith inside sleeve 72, the edges of the cups 74 bearing against the inside of sleeve 72. In a presently preferred embodiment, the cups 74 are comprised of a soft resilient material such as Neoprene TM threaded over a mandrel 76 which is threaded at both ends to serve as a connector between the uppermost sucker rod 64 and the rest of the string 16 of sucker rods. Mandrel 76 is provided with a shoulder 78 for supporting cups 74 such that movement of the cups 74 in the direction opposite the direction of movement of sucker rod 64 is constrained by shoulder 78 as sucker rod 64 moves upwardly and by the end margin 80 of sucker rod 64 as sucker rod 64 moves downwardly.

As noted above, the seal in such pump actuators as are disclosed in my U.S. Pat. No. 3,643,432 has proven problematical, and the lower sealing means of the pump actuator 10 of the present invention remedies that problem. In particular, the packing gland formed by cups 74 and sleeve 72 has a much larger working area than that of the packing gland of that prior patent and, perhaps more importantly, works in a relatively clean environment compared to the packing gland of the pump described in that prior patent. Further, when the cups 74 do wear out, they are simple to change because of the manner in which they are carried on mandrel 76.

Means including a floating piston bleeder valve 82 is provided for routing air or gas to and from power cylinder 60 in the form of the connector lines 84 and 88 and the respective couplings 86 and 90 as well as the first and second activator buttons 92 and 94 on the respective first and second ends thereof for shifting the bleeder valve 82 between first and second positions. Bleeder valve 82 is a commercially available, three-way valve which receives air or gas from high pressure line 49 through connector line 88 and selectively routes that air or gas through the connector line 84 into power cylinder 60 on the side of piston 62 opposite base plate 50. Insofar as this valve 82 is described in detail in each of my prior U.S. Pat. Nos. 3,643,432, 3,782,247 and 3,986,355, no further description is needed herein.

First and second pivot arms 96 and 98 are mounted on brackets 100 and 102 near the respective ends of bleeder valve 82 for contact by respective first and second contactors 104 and 106 as will be explained. Means reciprocating with piston 62 is provided for mounting respective first and second contactors 104 and 106 in close proximity to pivot arms 96 and 98 in the form of a spreader 108 having first and second cables 110 and 112 suspended from the respective first and second ends thereof which is mounted to sucker rod 64 by a yoke 114 having an adjustable clamp or wing nut 116 mounted therein. The first and second contactors 104 and 106 are mounted by respective clamps or wing nuts 118 and 120 to the cables 110 and 112 at positions selected so as to cause the first contactor 104 to contact the first pivot arm 96 on the upstroke of piston 62 to cause first pivot arm 96 to engage first activator button 92 to shift bleeder valve 82 from the first to the second position. Likewise, the position of second contactor 106 is selected so as to cause second contactor 106 to contact second pivot arm 98 on the downstroke of piston 62 to cause second pivot arm second pivot arm 98 to engage second activator button 94 to shift bleeder valve 82 back to the first position. Weights 122 are preferably attached to the ends of each of the cables 110 and 112 and a loop 124 formed in each of the pivot arms 96 and 98 through which the cables 110 and 112 pass, and together with the spreader 108 and yoke 114, comprise means for mounting the respective first and second contactors 104 and 106 in close proximity to the first and second pivot arms 96 and 98.

By reference to the figures, the operation of the pump actuator 10 will now be described. Air or gas from high pressure line 49 is fed directly into power cylinder 60 between base plate 50 and piston 62, e.g., on the first side of piston 62, through the coupling 90 and fitting 91 to maintain sufficient pressure to lift piston 62 at all times. As noted above, high pressure line 49 also feeds directly into floating piston bleeder valve 82 and air or gas is routed out of bleeder valve 82 through connector line 84 into power cylinder 60 above piston 62, e.g., on the side of piston 62 opposite base plate 50, depending upon which of the activator buttons 92 and 94 was last depressed. If, for instance, the air or gas is routed to power cylinder 60 on the side of piston 62 opposite base plate 50, e.g., the second side, the pressure above piston 62, along with the weight of the string of sucker rods 16, plunger 26, and the fluid contained therein, combines with that pressure on the second side of piston 62 to overcome the pressure in the power cylinder 60 below piston 62 and piston 62 travels downwardly, the sucker rod 64 likewise traveling downwardly along with the string 16 and spreader 108 mounted thereto. As piston 62 nears the base plate 50 at the bottom end of power cylinder 60 under the influence of the air or gas routed into power cylinder 60 on the side of piston 62 opposite base plate 50, second contacter 106 contacts the loop 124 of second pivot arm 98 to pivot arm 98 into engagement with second activator button 94, depressing second activator button 94 and shifting bleeder valve 82 so that the flow of air or gas into connector line 84 is shut off such that the only flow of air or gas is then routed into power cylinder 60 on the first side of piston 62 between base plate 50 and piston 62, causing piston 62 to reverse the direction of movement. Piston 62 continues on the upstroke until first contactor 104 contacts first pivot arm 96 and bleeder valve 82 is shifted from first position to second position.

A primary advantage of the construction of pump actuator 10 is the ease with which the length of the stroke of piston 62 can be adjusted for such purposes as, for instance, when the actuator 10 is used in connection with a bottom hole pump such as is shown at reference numeral 18. By moving the spreader up and down on sucker rod 64, the starting point of the stroke of piston 62 is quickly and conveniently changed, and by re-positioning the first and second contactors 104 and 106 along the length of the respective cables 110 and 112, the length of either the upstroke or downstroke, respectively, is adjusted. Further fine adjustments in stroke length can be accomplished simply by bending one or the other of the arms of the elongate spreader 108 up or down, an adjustment which can be accomplished even while pump actuator 10 is in operation.

Although the invention has been described in terms of the presently preferred embodiment shown in the figures, those skilled in the art who have the benefit of this disclosure will recognize that certain modifications can be made to the component parts thereof without changing the manner in which those component parts function to achieve and intended result. For instance, first and second pivot arms 96 and 98 can be angled toward each other so that a single cable (not shown) suspended from a yoke 114 mounted to sucker rod 64, and having both first and second contactors 104 and 106 mounted at different locations therealong. The component parts of a contactor mounting means constructed in this fashion would function in an equivalent manner to achieve the same result as that intended by the structure shown in the figures. Likewise, other combinations of connector hoses and valves can be utilized in place of the routing means comprised of connector lines 84 and 88 and the floating piston bleeder valve 82 without changing the function thereof. All such changes are intended to fall within the spirit and scope of the following claims.

What is claimed is:

1. A pneumatic pump actuator comprising:

a base plate adapted to be secured to a wellhead;

a power cylinder mounted to said base plate;

a piston mounted to a sucker rod extending through said power cylinder for reciprocation therein;

an external source of high pressure air or gas for supplying sufficient air or gas to a first side of said piston to lift said piston;

a floating piston bleeder valve intermediate said air or gas source and said power cylinder and having first and second activator buttons on the respective ends thereof for shifting said bleeder valve between first and second positions to route the air or gas into said power cylinder on a second side of said piston as well as the first side of said piston;

a spreader mounted to the sucker rod and having first and second cables suspended from the respective first and second ends thereof;

first and second pivot arms mounted near the respective ends of said bleeder valve;

first and second contactors mounted at different heights to the respective first and second cables, said first contactor contacting said first pivot arm as the piston nears one end of said power cylinder as the air or gas routed into said power cylinder on the first side of said piston lifts said piston when said bleeder valve is in said first position to pivot said pivot arm into engagement with the first activator button to shift said bleeder valve to said second position in which air or gas is routed into said power cylinder on both the first and second sides of said piston to reverse the direction of movement of said piston until said second contactor contacts said second pivot arm to pivot said second pivot arm into engagement with the second activator button to shift said bleeder valve from said second position to said first position.

2. The pump activator of claim wherein said spreader is releasably mounted to the sucker rod for positioning at different locations therealong to adjust the length of the stroke of said piston.

3. The pump activator of claim i wherein said first and second contactors are releasably mounted to the first and second cables for positioning at different locations therealong to adjust the length of the upstroke and the downstroke of said piston.

4. The pump activator of claim 1 wherein said first and second pivot arms are provided with loops through which the respective first and second cables pass to insure contact between said first and second pivot arms and said respective first and second contactors.

5. The pump activator of claim additionally comprising upper and lower sealing means at the openings in said power cylinder through which the sucker rod passes.

6. The pump activator of claim 5 wherein the opening in said base plate through which the sucker rod passes is provided with a sleeve extending downwardly into the wellhead to which said base plate is mounted a length longer than the stroke of said piston, said sealing means being mounted to the sucker rod for reciprocation therewith inside said sleeve.

7. The pump activator of claim 6 wherein said sealing means is mounted on a mandrel mounted to the sucker rod and having a shoulder formed therein for supporting said sealing means between the shoulder and the end margin of the sucker rod.

8. A pneumatic pump actuator comprising:

a power cylinder having a sucker rod passing therethrough;

a piston mounted to the sucker rod for reciprocation inside said power cylinder;

means for selectively routing relatively high pressure air or gas into said power cylinder on a first and both the first and a second side of said piston;

a floating piston bleeder valve shiftable from a first to a second position and back to said first position for supplying air or gas to said routing means and on to the first or the first and second sides of said piston;

first and second pivot arms mounted near the ends of said bleeder valve;

first and second activator buttons on the ends of said bleeder valve for shifting said bleeder valve when engaged by said respective first and second pivot arms from said first position to said second position and back to said first position;

first and second contactors; and means reciprocating with said piston for mounting the respective first and second contactors in close proximity to said first and second pivot arms, said first and second contactors being mounted thereto at positions selected so as to cause said first contactor to contact said first pivot arm on the upstroke of said piston to cause said first pivot arm to engage said first activator button to shift said bleeder valve from said first to said second position to reverse the direction of travel of said piston and said second contactor to contact said second pivot arm on the downstroke of said activator button to shift said bleeder valve from said second to said first position to again reverse the direction of travel of said piston.

9. The pump actuator of claim 8 additionally comprising means for sealing the openings in said power cylinder through which the sucker rod passes.

10. The pump actuator of claim 9 wherein said power cylinder is provided with a sleeve extending from one end thereof and concentric with the sucker rod passing therethrough, said sealing means being mounted to the sucker rod for reciprocation therewith and bearing against the inside surface of said sleeve.

11. The pump actuator of claim 10 wherein said contactor mounting means is mounted to the sucker rod on the end of said power cylinder opposite the end to which said sleeve is mounted.

12. The pump actuator of claim 8 wherein said contactor mounting means comprises a spreader having first and second cables mounted to the ends thereof, each of said first and second contactors being mounted to the respective first and second cables.

13. The pump actuator of claim 12 wherein said first and second contactors are releasably mounted to the respective first and second cables for positioning at different locations therealong to adjust the length of the stroke of said piston.

14. The pump actuator of claim 13 wherein said spreader is releasably mounted to the sucker rod for positioning at different locations therealong to adjust the length of the stroke of said piston.

15. The pump actuator of claim 8 wherein said contactor mounting means comprises a spreader to which said first and second contactors are mounted, each of said first and second contactors being mounted at a different position therealong.

* * * * *